US008649670B2

(12) United States Patent
Lu et al.

(10) Patent No.: US 8,649,670 B2
(45) Date of Patent: Feb. 11, 2014

(54) WATER HEATER

(76) Inventors: Yijian Lu, Fujian (CN); Jinhe Lu, Fujian (CN)

( * ) Notice: Subject to any disclaimer, the term of this patent is extended or adjusted under 35 U.S.C. 154(b) by 0 days.

(21) Appl. No.: 13/583,228

(22) PCT Filed: Mar. 8, 2011

(86) PCT No.: PCT/CN2011/071602

§ 371 (c)(1),
(2), (4) Date: Oct. 5, 2012

(87) PCT Pub. No.: WO2011/110083

PCT Pub. Date: Sep. 15, 2011

(65) Prior Publication Data

US 2013/0089309 A1 Apr. 11, 2013

(30) Foreign Application Priority Data

Mar. 10, 2010 (CN) ..... 2010 2 0127603 U

(51) Int. Cl.
*H05B 3/60* (2006.01)

(52) U.S. Cl.
USPC ..... 392/315; 392/311; 392/314; 392/317; 392/322

(58) Field of Classification Search
None
See application file for complete search history.

(56) References Cited

U.S. PATENT DOCUMENTS 1,103,274 A * 7/1914 Denhard ..... 392/314
1,294,015 A * 2/1919 Young ..... 392/334
1,328,068 A * 1/1920 Young ..... 392/324
1,356,846 A * 10/1920 Young ..... 392/334
1,480,515 A * 1/1924 Caselli ..... 392/314
2,748,253 A * 5/1956 Bremer ..... 392/318
3,796,857 A * 3/1974 Henley et al. ..... 392/315
3,864,543 A * 2/1975 Mohr ..... 392/323
3,867,610 A * 2/1975 Quaintance ..... 392/318
3,925,638 A * 12/1975 Scatoloni ..... 392/320
6,072,937 A * 6/2000 Benade et al. ..... 392/336

FOREIGN PATENT DOCUMENTS

CN 2224991 Y 4/1996
CN 2235096 Y 9/1996
CN 201093687 Y 7/2008
CN 101245948 A 8/2008
CN 101349470 A 1/2009
CN 101825332 A 9/2010
CN 201607000 U 10/2010
DE 3000498 A1 7/1981
EP 0036322 A1 9/1981

* cited by examiner

*Primary Examiner* — Thor Campbell

(57) ABSTRACT

A water heater comprises an inner container (1) and an outer container (2). An upper part of the inner container (1) is connected with an insulating water inlet pipe (3) which communicates with a cavity of the inner container (1); the outer container (2) is provided to encase the inner container (1) and it is axially movable relative to the inner container (1); two different heating electrodes (4) are connected with one end of the inner container (1) and one end of the outer container (2) respectively; water outlet holes (5) are provided on the inner container (1) and the outer container (2). As a result, the insulating water inlet pipe forms a hot water supply circuit in a sandwiched layer between the inner and the outer containers. By adjusting the spaces between the inner and the outer containers to regulate electrical current, water temperature control is achieved.

6 Claims, 1 Drawing Sheet

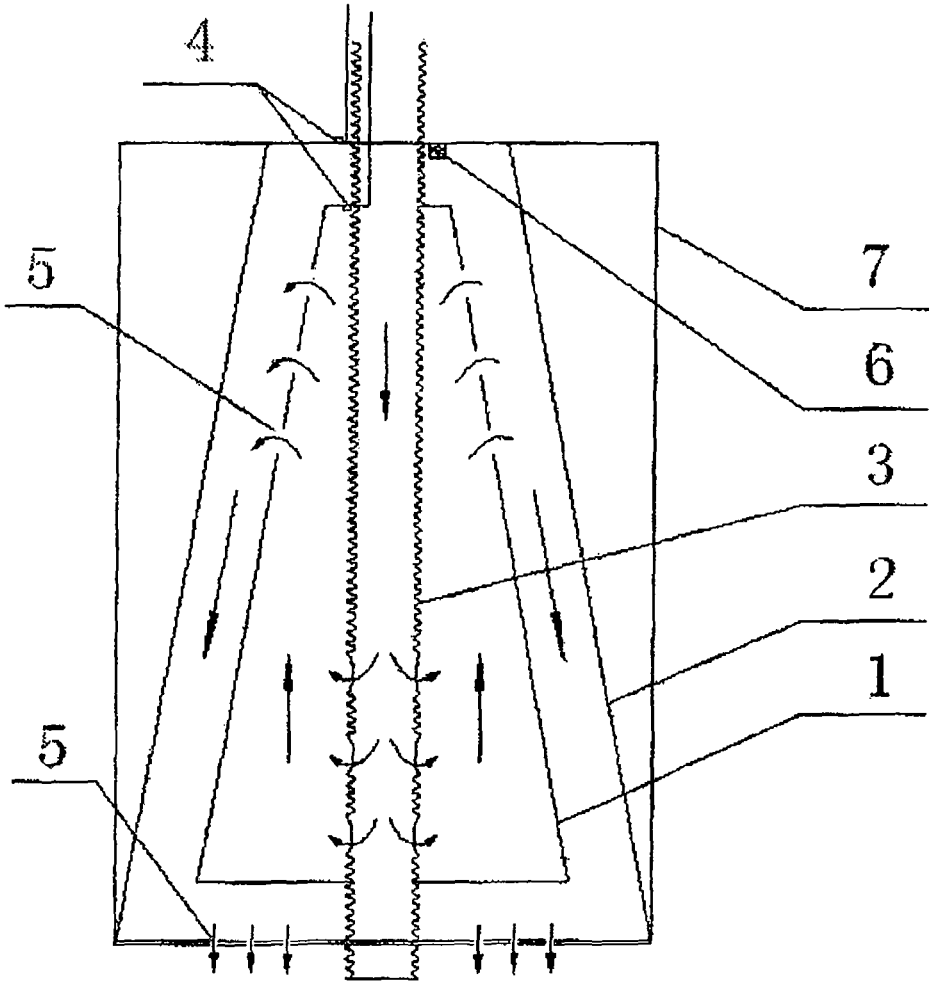
4
5
7
6
3
2
1
5

WATER HEATER

FIELD OF THE INVENTION

The present invention relates to a kind of water heater and more specifically relates to a kind of electrical water heater.

BACKGROUND OF THE INVENTION

Currently, an electrical water heater commonly available in the market usually comprises an electrical heating wire, an inner container and a temperature controller etc. During actual use, the electrical water heater has to heat up the water from time to time to maintain water temperature. Accordingly, more electricity will be wasted. Also, the time required for heating is long and there are deeper concerns about the heater's safety during its actual use. Besides, the existing electrical water heater is relatively large in size and requires more spaces for installation.

BRIEF SUMMARY OF THE INVENTION

An object of the present invention is to provide a water heater which is simple in structure, small in size, convenient to use and which can quickly regulate water temperature and achieve high heating efficiency.

A technical proposal of the present invention is detailed as follows: A water heater comprising an inner container and an outer container is characterized in that an upper part of the inner container is connected with an insulating water inlet pipe which communicates with a cavity of the inner container; the outer container is provided to encase the inner container and it is axially movable relative to the inner container; two different heating electrodes are connected with one end of the inner container and one end of the outer container respectively; water outlet holes are provided on the inner container and the outer container; and as a result, the insulating water inlet pipe forms a hot water supply circuit in a sandwiched layer between the inner and the outer containers.

The present invention has the following advantages: It has a simple structure and a practical design. By adjusting the distance between the heating electrodes of the inner and the outer containers to regulate electrical current, the water heater of the present invention can heat up water quickly and achieve easy control of water temperature. Also, the water heater of the present invention has a small size with quick heating speed and little loss of heat energy, and it is also safe and easy to use.

BRIEF DESCRIPTION OF THE DRAWINGS

FIG. 1 is a structural view of the present invention.

DETAILED DESCRIPTION OF THE INVENTION

As shown in FIG. 1, the present invention comprises an inner container 1 and an outer container 2, and it is characterized in that an upper part of the inner container is connected with an insulating water inlet pipe 3 which communicates with a cavity of the inner container; the outer container is provided to encase the inner container and it is axially movable relative to the inner container; two different heating electrodes 4 are connected with one end of the inner container and one end of the outer container respectively; water outlet holes 5 are provided on the inner container and the outer container; and as a result, the insulating water inlet pipe forms a hot water supply circuit in a sandwiched layer between the inner and the outer containers.

In order to adjust spaces between the inner and the outer containers, a top panel and a bottom panel of the outer container are fitted with the insulating water inlet pipe. Outer wall of the insulating water inlet pipe is connected via screw threads with inner screw threads inside openings on the outer container; and as a result, the outer container can move upward or downward along the insulating water inlet pipe when it rotates clockwise or anti-clockwise.

To avoid clashing of the inner and the outer containers or to avoid electric arc when the inner and the outer containers are too close between each other, an insulating block ring 6 is provided between the inner container and the outer container.

For more convenient operation and to avoid human body from direct contact with the outer container which is made of metal, a plastic case 7 which can drive the outer container to rotate is provided to encase the outer container.

To prevent water leakage at connecting parts between the insulating water inlet pipe and the inner and outer containers, the connecting parts between the insulating water inlet pipe and the inner and outer containers are provided with seal rings.

Operation principle of the present invention is detailed as follows: a top part and a bottom part of both the inner and the outer containers both made of metal are provided with identical screw-threaded openings. The inner and the outer containers are linked up together by the insulating water inlet pipe. The insulating water inlet pipe is hollow and provided with screw threads corresponding to the screw-threaded openings, and it is also made of plastic and its bottom end is sealed. One end of the inner container and one end of the outer container are respectively connected with a heating electrode. A live wire enters into the insulating water inlet pipe and then exits by passing through a small hole on the insulating water inlet pipe, and after that, it is fixed onto the heating electrode of the inner container via a screw. A neutral wire is disposed along an outer upper part of the insulating water inlet pipe and fixed onto the heating electrode of the outer container via a screw. Accordingly, an electrode space is formed between the inner container and the outer container. In other words, an electrical field is formed. Water inside the electrical field acts as a conductor and also a heat receiver. Since the electrical field uses water directly as an electrical conductor, materials such as electrical resistance wires etc are no longer required. As a result, lots of materials can be saved, and the service life of the entire water heater is also prolonged. Also, since the electrical field uses water directly as a heat receiver, heat generated by the water heater is directly absorbed by the water. As a result, the water is heated up very quickly, and the electricity and heat conversion ratio is very high.

While the inner container maintains in a fixed position, the outer container can be driven to move upward and downward by rotating the plastic case. When the outer container moves upward, there are more spaces between the inner and the outer containers and there is a decrease in the volume of electrical current that passes through. As a result, water discharged from the water heater has a decreased water temperature. When the container moves downward, there are fewer spaces between the inner and the outer containers and there is an increase in the volume of electrical current. As a result, water discharged from the water heater has an increased water temperature.

As shown by the above disclosure, the present invention has a simple structure and a practical design. Electrical current is also regulated by adjusting the spaces between the inner and the outer containers. Accordingly, the water heater of the present invention can be easily operated to control water temperature and achieves good heating effect and high heating efficiency. The water heater of the present invention is more practicable and therefore suitable for extensive promotion in the market.

The above disclosure is only a more preferred description of the present invention. Any equivalent changes and modifications within the scope of the present invention should also fall within the scope of protection of the present invention.

What is claimed is:

1. A water heater comprising an inner container and an outer container, characterized in that an upper part of the inner container is connected with an insulating water inlet pipe which communicates with a cavity of the inner container; the outer container is provided to encase the inner container and it is axially movable relative to the inner container; two different heating electrodes are connected with one end of the inner container and one end of the outer container respectively; water outlet holes are provided on the inner container and the outer container; and as a result, the insulating water inlet pipe forms a hot water supply circuit in a sandwiched layer between the inner and the outer containers.

2. The water heater as in claim 1, characterized in that a top panel and a bottom panel of the outer container are fitted with the insulating water inlet pipe; outer wall of the insulating water inlet pipe is connected via screw threads with inner screw threads inside openings on the outer container; and as a result, the outer container can move upward or downward along the insulating water inlet pipe when it rotates clockwise or anti-clockwise.

3. The water heater as in claim 1, characterized in that an insulating block ring is provided between the inner container and the outer container.

4. The water heater as in claim 1, characterized in that a plastic case which can drive the outer container to rotate is provided to encase the outer container.

5. The water heater as in claim 1, characterized in that connecting parts between the insulating water inlet pipe and the inner and outer containers are provided with seal rings.

6. The water heater as in claim 1, characterized in that the insulating water inlet pipe has screw threads on its outer wall.

* * * * *